United States Patent [19]

Schindler

[11] Patent Number: 4,549,777

[45] Date of Patent: Oct. 29, 1985

[54] LIBRARY SHELF SUPPORT SYSTEM

[75] Inventor: Michael D. Schindler, Fort Atkinson, Wis.

[73] Assignee: Spacesaver Corporation, Fort Atkinson, Wis.

[21] Appl. No.: 610,770

[22] Filed: May 16, 1984

[51] Int. Cl.[4] ..... A47B 53/00

[52] U.S. Cl. ..... 312/198; 312/199; 312/201; 312/223; 211/1.5

[58] Field of Search ..... 108/59, 20; 211/1.5, 211/26; 312/198, 201, 223, 208, 250, 199

[56] References Cited

U.S. PATENT DOCUMENTS

| | | | |
|---|---|---|---|
| 2,706,573 | 4/1955 | Ingold | 312/199 |
| 3,635,174 | 1/1972 | Ball et al. | 312/223 X |
| 3,923,354 | 12/1975 | Young | 312/199 X |
| 3,957,322 | 5/1976 | Mastronardi | 312/198 |
| 4,017,131 | 4/1977 | Camenisch | 312/198 |
| 4,094,561 | 6/1978 | Wolff et al. | 312/223 |
| 4,119,376 | 10/1978 | Moyer | 312/198 |
| 4,307,922 | 12/1981 | Rhodes, Jr. | 211/1.5 X |
| 4,437,711 | 3/1984 | Dahnert | 312/198 X |
| 4,441,617 | 4/1984 | Forsberg | 211/1.5 |
| 4,467,924 | 8/1984 | Morcheles | 211/1.5 |

*Primary Examiner*—William E. Lyddane
*Assistant Examiner*—Peter A. Aschenbrenner
*Attorney, Agent, or Firm*—Fuller, House & Hohenfeldt

[57] ABSTRACT

A guide channel member for a shelving system permits a shelf with an electrical safety device mounted thereon to be vertically repositioned while minimizing potential damage to the wire leads and maintaining a neat appearance. The invention is particularly useful in mobile storage systems wherein movement of a movable unit is stocked, thereby preventing injury to a person standing next to the unit, when the safety device is actuated. The channel member defines a vertically oriented slot leading to a vertical passage. The wires pass from the safety device, through the slot, along the vertical passage, and to the system control unit. Storing excess wires in the channel member permits convenient repositioning of the shelf while protecting and hiding the wires.

4 Claims, 4 Drawing Figures

LIBRARY SHELF SUPPORT SYSTEM

BACKGROUND OF THE INVENTION

1. Field of the Invention

This invention pertains to electrical safety devices, and more particularly to apparatus which facilitates positioning electrical safety devices at desired locations on mobile storage systems.

2. Description of the Prior Art

Horizontally movable systems for storing books and other materials are well known. The mobile storage units may be moved along a building floor under either manual or electrical power. It is conceivable that a person may operate a mobile unit without realizing another person is standing in the aisle next to the unit. That situation is especially dangerous with electrically powered mobile units. To reduce the danger to a person caught next to a moving unit, various safety devices are commonly employed. A particularly desirable safety device is an elongated pressure operated safety switch attached horizontally along the external edge of a shelf. Momentary contact of the safety switch breaks the circuit controlling the mobile unit motors to stop movement of the unit.

A problem with present safety switch designs is the exposure of the electrical wires leading to the switches, thus creating the risk of damage to the wires. A related problem is that, in providing a neat appearance as well as minimizing the amount of exposed wire, the wire lengths are usually cut to accommodate only one shelf location within the unit frame. As a result, the shelf with the safety switch cannot be readily repositioned on the frame without altering the wires. Depending on the desired new location of the shelf relative to the original location, a way must be found to either pull additional wire from somewhere in the circuit, or to protect and hide newly created excess wire; both procedures are time consuming and inconvenient.

Thus, a need exists for apparatus which facilitates vertical adjustment of mobile storage unit shelves having a safety switch attached thereto while maintaining wire protection and a neat appearance.

SUMMARY OF THE INVENTION

In accordance with the present invention, a mobile storage unit is provided having safety devices mounted to storage shelves which may be quickly and conveniently repositioned on the unit frame while protecting the electrical wires and maintaining a neat appearance. This is accomplished by apparatus which includes an elongated guide channel member joined to an upright unit frame. The channel member defines a vertical passage for storing and protecting the wires and includes one or more slots through which the wires pass from the safety device to the vertical passage.

The safety device, and thus the channel member, may be mounted to either or both mobile and stationary units. The channel member may extend the full height of the storage unit, thus permitting the wires to be fed to the safety device from either the top or bottom of the unit.

The wires pass from the safety device through a channel member slot and into a wire passage wherein they are protected. In addition, the channel member hides and stores the access wires, thereby permitting convenient repositioning of the shelf.

The closed wire protecting passage is preferably created through the cooperation of the channel member and the storage unit frame. The channel member vertical passage is formed with an open side, and the channel member is fastened to the storage unit frame such that the vertical passage opening is closed by the frame wall. Consequently, the storage unit frame and the channel member combine to both protect and hide the wires.

Other objects and advantages of the invention will become apparent to those skilled in the art from the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
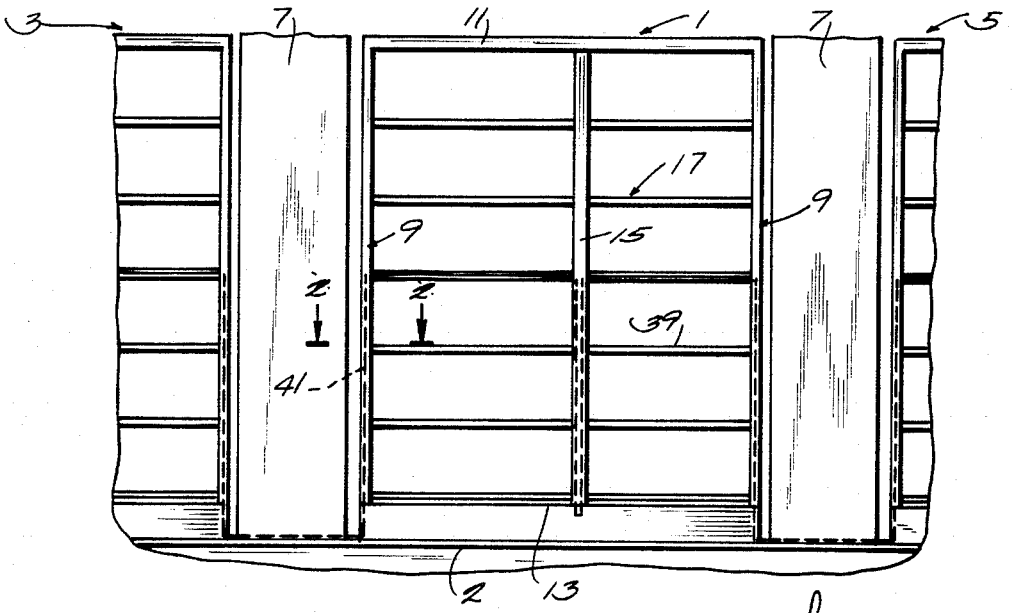
FIG. 1 is a front view of a stationary unit of a mobile storage system which utilizes the wire guiding channel member of the present invention.

Referring to FIG. 1, a storage unit 1 of a mobile storage system is illustrated which includes the present invention. Mobile storage systems find particular usefulness in libraries and offices, but it will be understood that the invention is not limited to material storage applications.

The storage unit 1 may be either a movable or stationary unit; merely for illustrative purposes, the unit 1 is depicted as a stationary unit. Also merely by way of example, the storage unit 1 is shown in conjunction with similar stationary units 3 and 5 which may be separated by building columns 7. It will be understood that corresponding movable units of the mobile storage system, not shown, are adapted to move along the floor 2 in association with the stationary units 1, 3 and 5 to create conventional mobile storage systems as disclosed in U.S. Pat. No. 3,640,595 incorporated herein by reference.

The storage unit 1 may be manufactured with a pair of upright side frames 9 joined at their upper ends by a top brace 11. The lower ends of the side frames are joined to a horizontal base member 13, which is anchored to the building floor 2 by suitable and conventional devices. In the case of a movable unit, the base is equipped with suitable wheels and other well known mechanisms for moving the storage unit along the floor. The unit 1 may also include an upright center frame 15.

Figure 2:
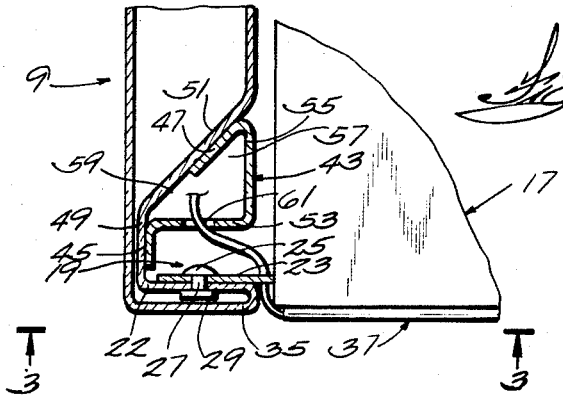
FIG. 2 is an enlarged sectional view taken along lines 2—2 of FIG. 1.
Figure 3:
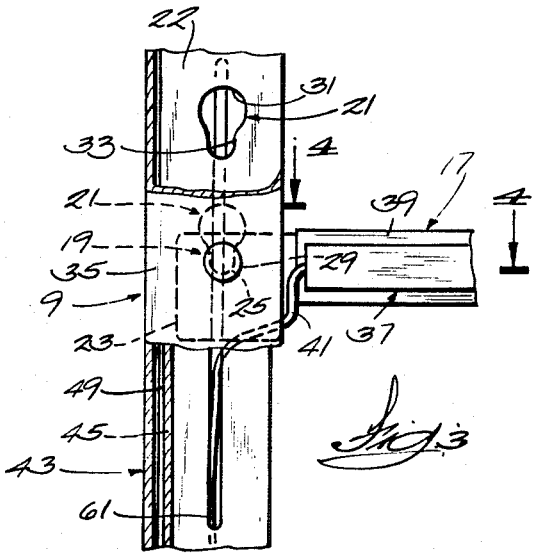
FIG. 3 is a partially broken front view taken along lines 3—3 of FIG. 2.
Figure 4:
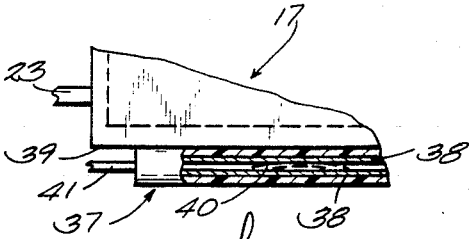
FIG. 4 is an enlarged partial sectional view taken along lines 4—4 of FIG. 3.

Suspended between upright frames 9 and 15 are a plurality of conventional shelves 17 which typically are utilized for storing books and similar items. As best shown in FIGS. 2 and 3, the shelves may be suspended by rivets 19 secured to the shelves and engaged in key hole slots 21 in frame wall 22. For that purpose, each shelf is provided with vertically disposed ear-like shelf supports 23 extending from both ends. The rivets 19 are permanently joined to the shelf supports 23 at the rivet heads 25 and shanks 27. Each rivet includes an annular flange portion 29. To receive the rivets and for supporting the shelves, the key hole slots are formed with an upper opening 31 large enough for the rivet flange 29 to pass through and a lower opening 33 large enough to accommodate rivet shank 27 but smaller than the diameter of the rivet flange, all in a well known manner. To permit flexibility in locating the shelf in the mobile storage system, the key hole slots are spaced at generally regular intervals along the frames 9 and 15. To hide the rivet flanges and thus provide an attractive appearance, the frames may be constructed with a flat front wall 35 generally parallel to the wall 22.

To prevent injury to a person standing in the aisle between the stationary unit 1 and a movable unit, or between two movable units, in case of accidental start-up of an electrically powered movable unit, a safety device is commonly employed. Actuating the device de-energizes the movable unit drive motors in well known fashion. In the construction illustrated in FIGS. 1–4, the safety device is in the form of an elongated pressure actuated electrical switch 37 commonly known as a safety tape. Pressing the tape at any point along the length thereof actuates the switch through contacts 38 which are normally held apart by spring members 40. The safety tape 37 is mounted by well known means to the front face 39 of one or more shelves 17. Usually the safety tape is placed about waist height above the floor. The safety tape may be applied to shelves of either or both the stationary unit 1 and the adjacent movable unit. The safety tape includes one or more wire leads 41 which electrically connect the tapes to the mobile storage system control unit, not illustrated in FIG. 1. The wires 41 may follow the side frames 9 and center frame 15 to the base 13, from which, in the case of stationary unit 1, they may pass to nearby stationary units 3 and 5 by any appropriate route. Alternatively, the wires may pass upwardly from the safety tape along the upright frames 9 and 15. In either case, the wires may pass directly from either a stationary or a movable unit to the control without also passing through another unit.

In accordance with the present invention, the wires 41 of safety tapes 37 are both protected from damage and hidden from view in the vertical runs along the frames 9 and 15 by elongated guide channel members 43. The channel members 43 may extend from approximately the bottom of the unit 1 to slightly above the highest expected location of a shelf 17 bearing a safety tape 37. Normally that would be slightly higher than waist height. To permit the wires to pass either upwardly or downwardly from the safety tape and thereby enhance the versatility and convenience of the invention, the channel members may extend the full height of the storage unit.

In the construction of the channel member 43 illustrated in FIG. 2, the channel member is fabricated as a four-legged member. Legs 45 and 47 are adapted to conform to the contours of the walls 49 and 51, respectively, of frame 9, which may form an obtuse angle, and to which the legs 45 and 47 are fastened. The legs 45 and 47 are secured to the respective frame walls 49 and 51 by any appropriate means, such as rivets or threaded fasteners, not shown in FIGS. 2 and 3. Legs 53 and 55 of the channel member lie intermediate the legs 45 and 47, and legs 47, 53, and 55 form a vertical wire passage 57. To efficiently utilize the available space defined by frame walls 22, 49, and 51, the vertical passage 57 is preferably generally triangular-shaped. In the preferred embodiment, the passage 57 is not completely enclosed but has an opening 59 located between the edge of leg 47 and the junctions of legs 45 and 53. When the channel member is fastened to the frame, the wall 51 cooperates with leg 47 to create a completely enclosed passage.

To provide access to the wire passage 57 for the wires 41, leg 53 of the channel member 43 includes one or more vertically disposed slots 61. As best illustrated in FIGS. 2 and 3, the wires pass from the safety tape 37, under and behind the shelf support 23, and into the slot 61. The width of the slot may be only sufficient for a wire to pass therethrough; a width of approximately 3/16 inch is considered satisfactory. The vertical midpoint of the slot is preferably located at the estimated location of the shelf to which the safety tape 37 is attached. The slots are long enough to accommodate several different positions of the shelves 17 on the frames 9 and 15 without excessive exposure of the wires. Accordingly, in the present embodiment, a six inch slot length is acceptable. Thus, the shelf with the safety tape attached thereto may be vertically adjusted through a range of about six inches before the wires become inordinately exposed between the safety tape and the channel member. During manufacture, the wires 41 may be cut long enough to suit the farthest possible location of the safety switch shelf from the control unit. If the shelf is located at any lesser distance from the control, the excess wire will be stored unobtrusively within the passage 57. Later repositioning of the shelf merely withdraws the stored wire. Repositioning the shelf is accomplished quickly and conveniently because the wires merely slide in and out of slot 61.

The channel member 43 of the present invention may be constructed of any suitable material. The preferred material is a strong and light weight plastic of a color and texture to match the decor of the mobile storage system.

Thus, it is apparent that there has been provided, in accordance with the invention, a library shelf support system which fully satisfies the objects, aims, and advantages set forth above. While the invention has been described in conjunction with specific embodiments thereof, it is evident that many alternatives, modifications, and variations will be apparent to those skilled in the art in light of the foregoing description. For example, more than one slot 61 may be utilized if more than one shelf 17 is equipped with a safety tape 37, and the slots may be located to suit the locations of the safety tapes. Accordingly, it is intended to embrace all such alternatives, modifications, and variations as fall within the spirit and broad scope of the apended claims.

I claim:

1. In combination with a mobile storage system unit having a base, at least two spaced upright frames joined to the base, at least one storage shelf suspended between the frames and repositionable therealong, and an electrical safety device mounted to the shelf for controlling the mobile storage system and having wire leads, an elongated vertically disposed guide channel member fastened to an upright frame, the channel member defining a vertical passage extending the length thereof for protecting and storing the wires, the channel member defining at least one vertically disposed slot adapted to provide access to the vertical passage for the wires and being located in the vicinity of the shelf having the safety device mounted thereon, so that the wires pass from the safety device through the slot with a minimum of exposure and into the vertical passage wherein the wires are stored and withdrawn when repositioning the shelf.

2. The combination of claim 1 wherein the channel member is fabricated with multiple legs configured to conform to the contour of the storage unit frame to facilitate fastening thereto, and wherein the legs define the vertical passage.

3. The combination of claim 2 wherein the channel member legs define an elongated opening in the vertical passage, and wherein the frame walls cooperate with the channel member legs to completely enclose the vertical passage when the channel member is fastened to the frame.

4. The combination of claim 3 wherein the channel member legs define a generally triangular shaped vertical passage to conform to the contour of the frame, so that available space defined by the frame wall contours is efficiently utilized.

* * * * *